US007779562B1

(12) United States Patent
Loveless et al.

(10) Patent No.: US 7,779,562 B1
(45) Date of Patent: Aug. 24, 2010

(54) LOADER IMPLEMENT UNIVERSAL MOUNT

(76) Inventors: Allen L. Loveless, HC-6 Box 158, Doniphan, MO (US) 63935; Jason N. Abrams, P.O. Box 824, Doniphan, MO (US) 63935

( * ) Notice: Subject to any disclaimer, the term of this patent is extended or adjusted under 35 U.S.C. 154(b) by 387 days.

(21) Appl. No.: 11/906,316

(22) Filed: Oct. 2, 2007

(51) Int. Cl.
*E01H 5/04* (2006.01)
*E02F 5/14* (2006.01)

(52) U.S. Cl. ..... 37/231; 37/468; 414/686; 414/723; 403/116

(58) Field of Classification Search ..... 37/231, 37/468, 405; 172/272–275, 814; 414/723, 414/686; 403/321, 324, 116, 335–338
See application file for complete search history.

(56) References Cited

U.S. PATENT DOCUMENTS

| | | | | | |
|---|---|---|---|---|---|
| 1,867,187 | A * | 7/1932 | Soule et al. | 37/231 |
| 2,256,273 | A * | 9/1941 | Begley | 37/231 |
| 2,465,641 | A * | 3/1949 | Gardner | 280/407 |
| 2,883,776 | A * | 4/1959 | Orscheln | 172/788 |
| 3,252,716 | A * | 5/1966 | Gaterman | 280/479.1 |
| 3,767,075 | A * | 10/1973 | Leverenz | 414/713 |
| 3,845,577 | A * | 11/1974 | Naymik | 37/231 |
| 4,056,250 | A * | 11/1977 | Uchiyama | 248/674 |
| 4,106,645 | A * | 8/1978 | Janish | 414/723 |
| 4,619,060 | A * | 10/1986 | Knowlton | 37/231 |
| 4,720,233 | A * | 1/1988 | Meyer et al. | 414/686 |
| 4,846,624 | A * | 7/1989 | Hohn | 414/723 |
| 4,948,328 | A * | 8/1990 | Busch | 414/723 |
| 4,962,599 | A * | 10/1990 | Harris | 37/266 |
| 5,026,247 | A * | 6/1991 | Zimmerman | 414/703 |
| 5,050,321 | A * | 9/1991 | Evans | 37/232 |
| 5,098,252 | A * | 3/1992 | Sheesley et al. | 414/723 |
| 5,178,511 | A * | 1/1993 | Wedin | 414/703 |
| 5,265,355 | A * | 11/1993 | Daniels | 37/231 |
| 5,392,541 | A * | 2/1995 | O'Riordan | 37/468 |
| 5,647,153 | A * | 7/1997 | Gervais | 37/231 |
| 5,950,735 | A * | 9/1999 | Godbersen | 172/439 |
| 6,168,369 | B1 * | 1/2001 | Bright et al. | 414/724 |
| 6,364,561 | B1 * | 4/2002 | Droegemueller | 403/4 |
| 6,408,548 | B1 * | 6/2002 | Altheide | 37/268 |
| 6,618,965 | B1 * | 9/2003 | Schultz et al. | 37/232 |
| 6,860,706 | B2 * | 3/2005 | Godwin et al. | 414/723 |
| 7,108,475 | B1 * | 9/2006 | Gustafson | 414/723 |
| 7,493,712 | B2 * | 2/2009 | McCormick et al. | 37/468 |
| 2001/0053323 | A1 * | 12/2001 | Godwin et al. | 414/723 |
| 2006/0210384 | A1 * | 9/2006 | Warren | 414/723 |
| 2007/0025834 | A1 * | 2/2007 | Gustafson | 414/723 |
| 2007/0098538 | A1 * | 5/2007 | Zettel | 414/723 |
| 2009/0051163 | A1 * | 2/2009 | Frey et al. | 285/305 |
| 2009/0084005 | A1 * | 4/2009 | Ramun | 37/468 |

FOREIGN PATENT DOCUMENTS

JP 60181427 A * 9/1985

* cited by examiner

*Primary Examiner*—Thomas A Beach

(57) ABSTRACT

A universal mount bracket that provides two pairs of adapter plates, one pair for each side of the front end loader. Each adapter plate can be adjusted laterally to match the width of virtually any size loader arm produced, and then be adjusted to the overall width of the loader (distance between the left and right loader arms). Once each pair of adapter plates have been matched to the loader arms (left and right), the equipment implement must then be centered and secured in place to prevent any lateral displacement of the unit while the implement is in use.

7 Claims, 6 Drawing Sheets

LOADER IMPLEMENT UNIVERSAL MOUNT

CROSS REFERENCE TO RELATED APPLICATIONS

Not Applicable

STATEMENT OF FEDERALLY SPONSORED RESEARCH OR DEVELOPMENT

Not Applicable

REFERENCE TO A SEQUENCE LISTING, TABLE, OR AN APPENDIX

Not Applicable

BACKGROUND OF THE INVENTION

1. Field of Inventions

The present invention relates to adapter mounts that couple between front end loaders and equipment implements and, more particularly, to a loader implement universal mount designed to be adjustable to a broad range of loaders.

2. Background Information

Agricultural tractors are becoming more wide spread in their use, and have developed into a tool of necessity for the common farmer's success in today's agricultural world. These machines accomplish many tasks easily and quickly, such as cutting, bailing and transporting hay for feeding livestock, thus proving very essential. To achieve these tasks, many tractors are equipped with a lifting apparatus mounted on the front of the tractor called a front end loader, whereby an equipment implement fitted for that particular loader is attached at the end, and used as an extension of the front end loader.

In general, a variety of equipment implements, each being designed to accomplish a certain task, is mounted onto the front end loader, which in turn, is mounted onto the tractor. Tractor loaders using equipment implements have proven very effective for work purposes, but have become very widespread in design between the differing manufacturers that market these time saving tools. Because of the broad spectrum of manufacturers, there are literally thousands of varying models of loaders from past and present production years available to the user, creating even a broader base that must be matched by the equipment implement manufacturers. 50, for example, if a farmer had 3 different models of front end loaders, he would need a different equipment implement (for instance a pallet fork) to match up with each individual loaders distinct dimensions.

Among these different models of loaders, you will find that some attach to the equipment implement via a pin-on type connection, while others will utilize a quick attach connection. There are many different styles of quick attach connections available, each designed to enhance the speed and ease of connection between front end loader and equipment implement, but this invention deals particularly with the loaders and implements that are of the pin-on type. Typically, front end loaders have two arms that extend forward from each side of the tractor. These arms are mounted with hydraulic cylinders that allow the loader to be raised and lowered with the equipment implement attached thereto. Generally the right and left top loader arms consist of an extendable and contractible hydraulic cylinder which, pivotally protruding from the loader, mounts to the top of the equipment implement via a pivot pin. The lower right and left loader arms would then be non-extendable and stationary with the front end loader itself, mounting to the bottom of the equipment implement via a pivot pin as well.

Every pin-on style front end loader model varies dimensionally in overall loader width (outside distance between the left and right loader arms), pivot pin diameter, distance between the top pins and the bottom pins, as well as the individual loader arm width.

Sometimes, finding the correct equipment implement that fits the users particular front end loader, is difficult. Depending on the year, make, and model of the loader, it may be rather unlikely that the user will be able to locate a manufacturer that produces viable implements for their loader.

To this end, the invention described herein, addresses the incompatibilities between varying front end loader designs, which create an inability of having these varying pin-on type loaders attach to a single equipment implement or single implement attachment style. Therefore, to solve this problem, a universal mount, has been invented to provide a common coupling between loader and implement, whereby many dimensionally differing pin-on type loaders may be able to attach to the same equipment implement, thus eliminating the need for multiple equipment implements, while also creating a means by which early outdated model loaders may be fitted as well.

3. Description of Prior Art

Upon performing a patent search, the following patents/applications were found within our field of invention: application Ser. No. 11/540,989;

One particular solution, involves an invention found within application Ser. No. 11/540,989, located and illustrated in figure three. A trapezoidally recessed mount plate which slides around a dovetail wing that is dimensioned as to fit within the mount plate recess. Though not dealing directly with the issue of loader incompatibility, the inventor attempts to solve the said issue with this portion of his invention.

Upon examining the invention of application Ser. No. 11/540,989, it became evident that the dovetail shaped wing as described in paragraph [0032], is predisposed to become wore down and loosen over time and deteriorate through use or stress. As it loosens, it will begin to get sloppy in its relationship with the trapezoidally recessed plate that slides over it and be inclined to fail the user.

Additionally, when lifting with this design, all weight is lifted along the lower wing of the dovetail design, and said lifted weight, naturally compels the upper edge of the dovetail wing to pull away from the loader towards the object of weight, in an effort to remove itself from the trapezoidally recessed plate which holds it, therefore pivoting on the lower edge of the dovetail which is bearing the brunt of the lifting weight load.

Economically speaking, the invention described in application Ser. No. 11/540,989, would exceed an acceptable bill of materials cost, because of the oddly designed features which would require a large measure of machining and special tooling per part, therefore increases the cost dramatically, causing the invention to cost the average customer more than what it's usefulness would be worth.

BRIEF SUMMARY OF THE INVENTIONS

Briefly, in accordance with the present invention herein described, there is provided two universal mount brackets, one bracket for each side of the front end loader. Each adapter bracket will have a set of laterally manipulable adapter plates, each including an upper and lower set of holes. These adapter plates are designed to enclose each pair of loader arms, with a plate on the left and right side of the loader arm, creating a housing for each loader arm. Each adapter plate contains one or more upper pin holes, named upper pin hole options, and are designed to line up with the pin housing of the upper loader arm and attach via a pivot pin which is provided with the front end loader. The lower pin hole of each adapter plate is designed to attach to the pin housing of the lower loader arm via a pivot pin according to the same process. Each pair of adapter plates can be adjusted laterally to match the width of virtually any size loader arm, and thereafter be adjusted to the overall width of the loader (distance between the left and right loader arms). Once each pair of adapter plates have been matched to the loader arms (left and right), the equipment implement must be centered with the front end loader, and secured in place by four lock nuts, to prevent any lateral displacement of the unit while the implement is in use. Now that the adapter plates are adjusted, attached, and secured as instructed, a reliable universal adapter between loader and implement is ready for use.

It is therefore an object of the invention to create an adapter mount capable of attaching to a pin-on style front end loader.

It is another object of the invention to create an adapter mount capable of being adjustable so as to attach to differently dimensioned front end loaders by means of lateral manual manipulation of the adapter plates.

It is another object of the invention to create an adapter mount that is user friendly as well as efficient, dependable, durable, and inexpensive at customer level.

BRIEF DESCRIPTION OF THE DRAWINGS

A complete understanding of the present invention may be obtained by reference to the accompanying drawings, when considered in conjunction with the subsequent, detailed description, in which:

FIG. 4*b* is a perspective view of a universal mount showing where the side mount plates are to be affixed to by means of welding or the like;

DESCRIPTION OF THE PREFERRED EMBODIMENT

Figure 1:
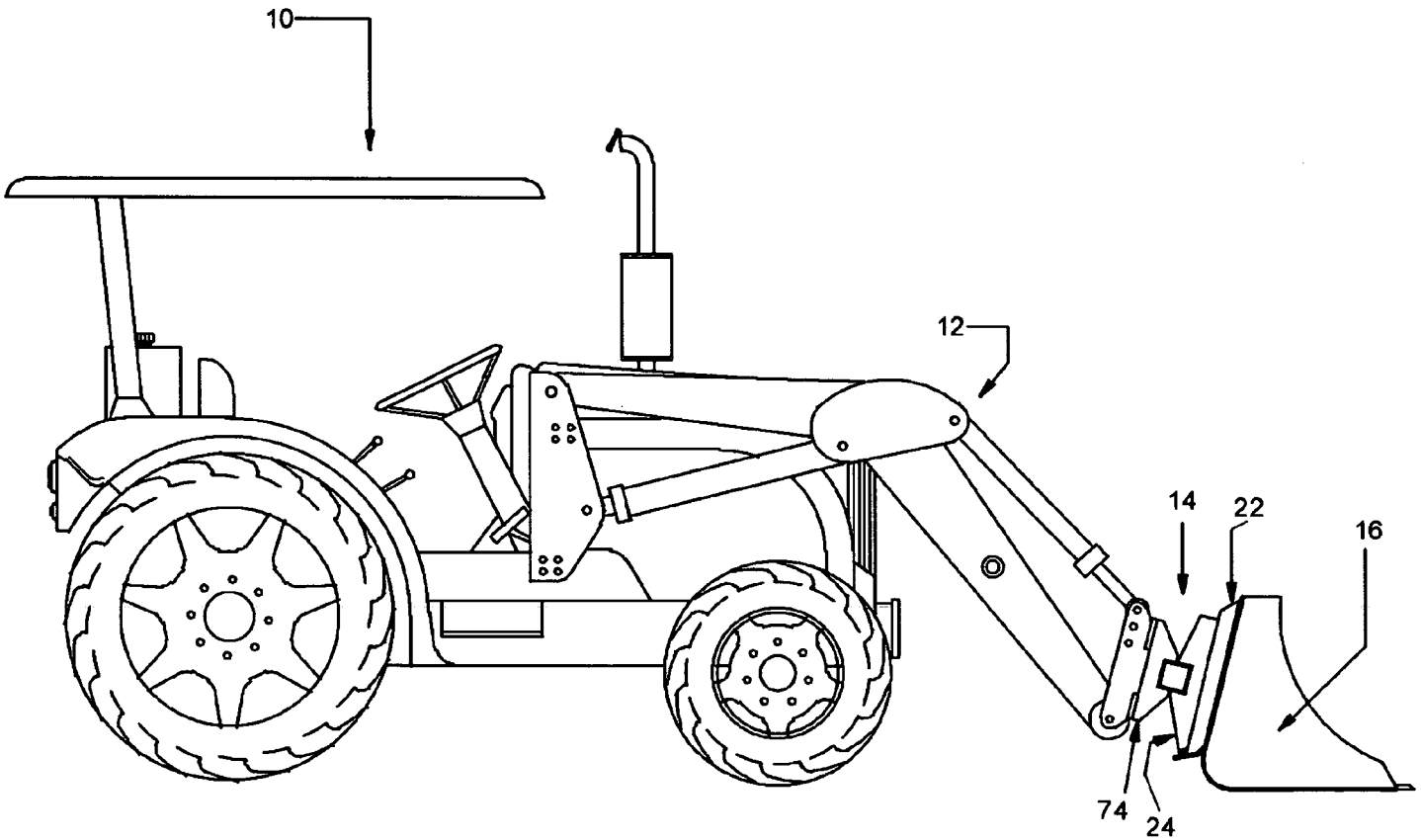
FIG. 1 is a side view of an agricultural tractor mounted with a front end loader connected to a quick attach assembly fitted with our universal mount and attached to a loader bucket.

FIG. 1 is a side view of an agricultural tractor 10 mounted with a front end loader 12 which is attached via pivot pins to universal mount assembly 74 fitted with a quick attach assembly 24, which creates a universal quick attach assembly 14, which is connected to an equipment implement, namely a loader bucket 16 having quick attach mounting plates 22 affixed on said bucket, allowing interconnection between the universal quick attach assembly 14 and quick attach mounting plates 22.

Figure 2A:
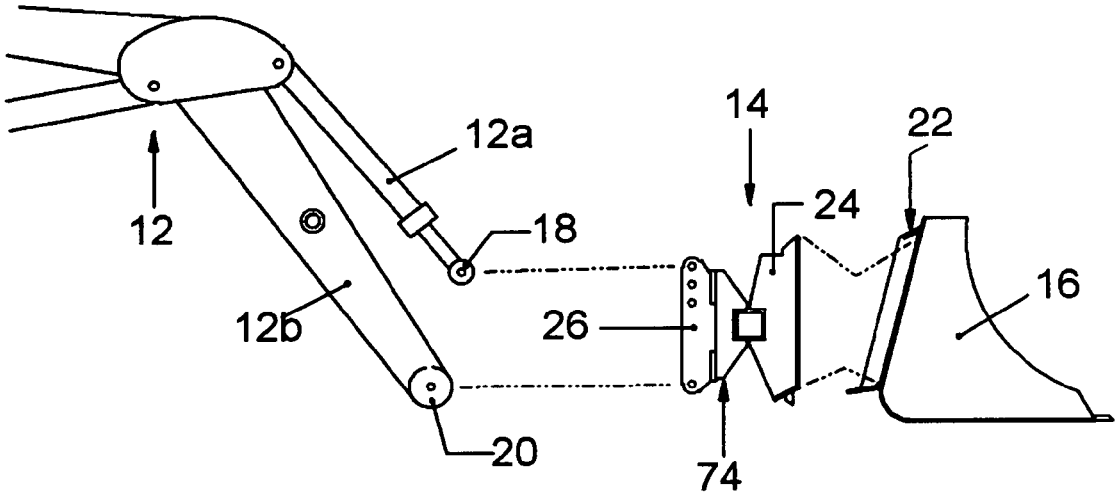
FIG. 2*a* is a side view of a front end loader, attached to the universal mount fitted to a quick attach assembly, and a loader bucket with quick attach mount plates.

FIG. 2*a* is a side view of a front end loader 12, a quick attach assembly with universal mounts 14, comprising of two universal mount brackets 26 affixed to a tube which is named the universal mount assembly 74, then fitted with a quick attach assembly 24, creating a universal quick attach adapter 14, which connects to a loader bucket 16 with quick attach mounting plates 22. The universal quick attach adapter 14 enables the loader to attach to matching quick attach implements such as a loader bucket 16 quickly, safely, and securely. Typically, a front end loader 12 is mounted to an agricultural tractor 10 frame, and has two upper hydraulically operated front end loader arms 12*a*, and a two lower front end loader arms 12*b*, each extending outwards from both sides of the tractor, to create a symmetrically balanced connection. Generally speaking, a front end loader 12 has four pin housings, an upper loader arm pin housing 18 for the left and right upper front end loader arm 12*a*, and a lower loader arm pin housing 20 for the left and right lower front end loader arm 12*b*.

In operation, a front end loader 12 connects to a universal quick attach adapter 14, which in turn, attaches to an implement of choice, in this case a loader bucket 16, thus creating a universal adapter between said front end loader 12 and said loader bucket 16.

Figure 2B:
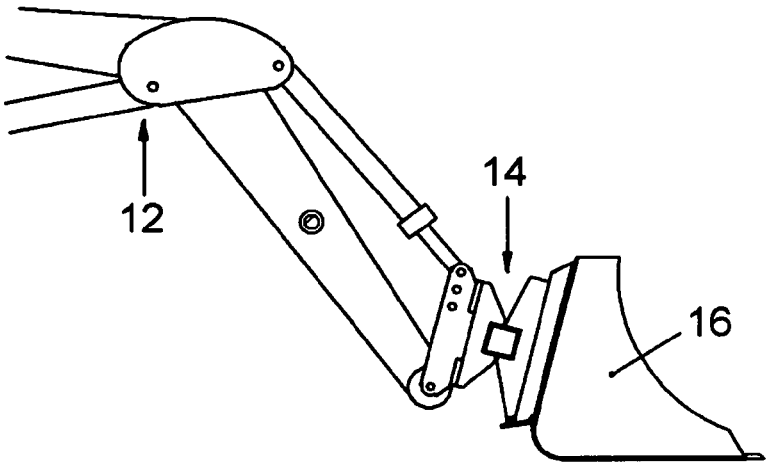
FIG. 2*b* is a side view of a front end loader, attached to the universal mount fitted to a quick attach assembly attached to a loader bucket with quick attach mount plates.

FIG. 2*b* is a an assembled side view of a front end loader 12, attached to a universal quick attach adapter 14 which is interconnected to a quick attach loader bucket 16.

Figure 3:
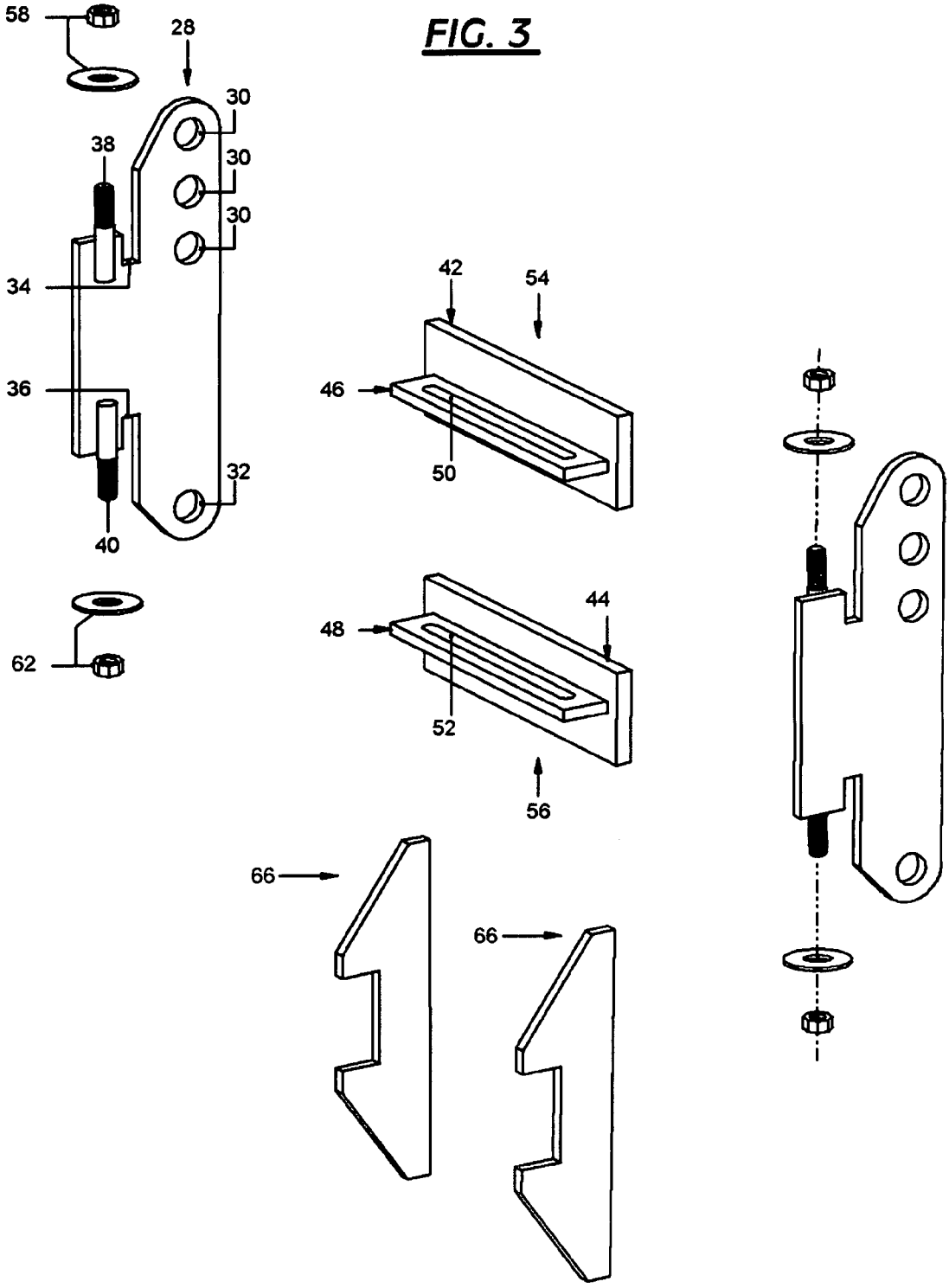
FIG. 3 is an exploded perspective view of a universal mount bracket.
Figure 5A:
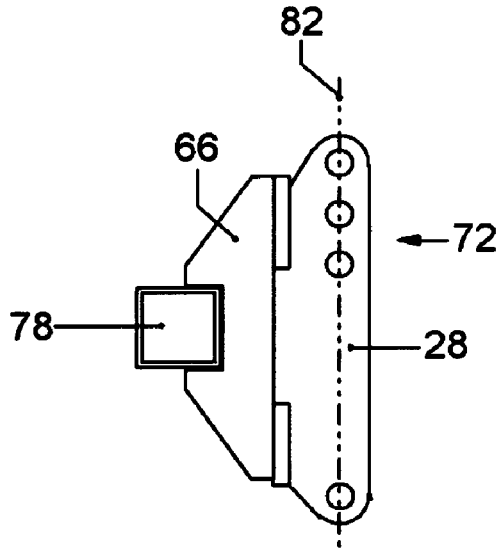
FIG. 5*a* is a side view of a universal mount bracket attached to a square tube.
Figure 5B:
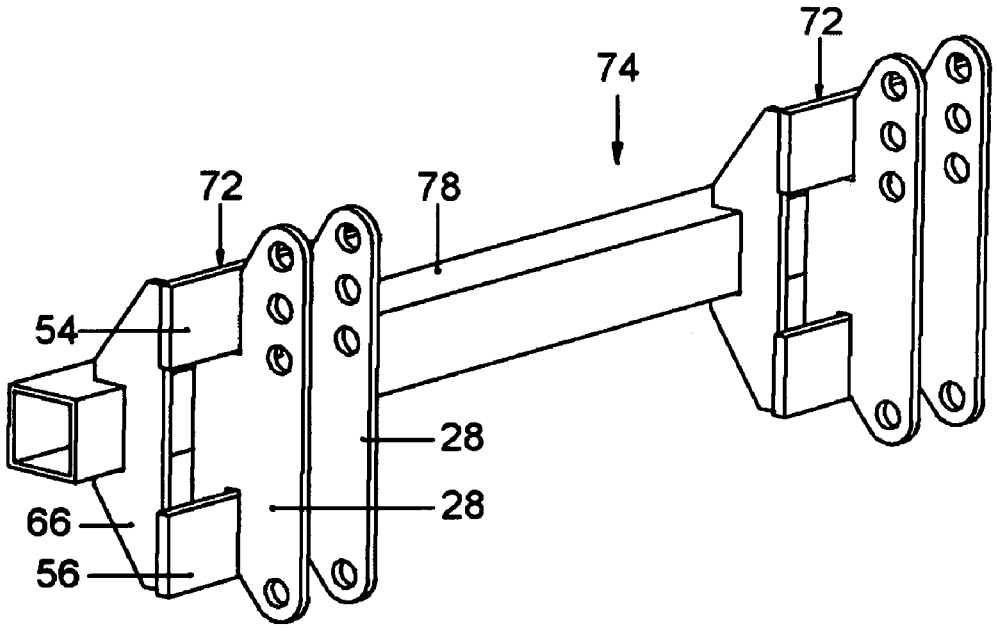
FIG. 5*b* is a rear perspective view of two universal brackets with side plates attached to a square tube.

FIG. 3 is an exploded perspective view of the universal mount bracket 26 comprising; of an adapter plate 28 adjacent to an additional adapter plate 28, each comprising of upper pin hole options 30, and a lower pin hole 32, which creates pin housings when secured adjacent to each other, a top and bottom center notch 34 and 36 each providing a housing which allows the adapter plate 28 to traverse laterally between the upper sliding plate 42 and lower sliding plate 44, a top bolt 38 for securing the adapter plate 28 to the upper adjuster plate 46 to prevent lateral displacement, a bottom bolt 40 for securing the adapter plate 28 to the lower adjuster plate 48 to prevent lateral displacement;

an upper adjuster bracket 54 comprising of an upper sliding plate 42 which perpendicularly affixes to an upper adjuster plate 46 containing an upper adjuster plate slot 50 which provides a slotted void which guides the top bolt 38 allowing functionality within it's boundaries, said upper adjuster bracket 54 designed in a fashion to provide a lateral relationship with the top center notch 34 of each adapter plate 28;

and a lower adjuster bracket 56 comprising of a lower sliding plate 44 which perpendicularly affixes to a lower adjuster plate 48 containing a lower adjuster plate slot 52 which provides a slotted void which guides the bottom bolt 40 allowing functionality within it's boundaries, said lower adjuster bracket 56 designed in a fashion to provide a lateral relationship with the bottom center notch 36 of each adapter plate 28;

a top nut and washer 58 providing the user with the ability to secure rigidness of the adapter plate 28 upon being fastened tightly to the top bolt 38 utilizing a thin steel washer, larger in diameter than the upper adjuster plate slot 50 allowing the user to fasten the top nut completely against the upper adjuster plate 46; a bottom nut and washer 62 providing the user with the ability to secure rigidness of the adapter plate 28 upon being fastened tightly to the bottom bolt 40 utilizing a thin steel washer, larger in diameter than the lower adjuster plate slot 52 allowing the user to fasten the bottom nut completely against the lower adjuster plate 48;

a left and right side mount plate 66 (being optional) comprising of a flat back edge allowing affixation to the left and right side of the universal mount bracket 26 to enable mountability to a tube 78, being square, round, or the like, via three sided notches cut out to match the shape and size of the tube 78, shown in FIGS. 5A and 5B.

Figure 4A:
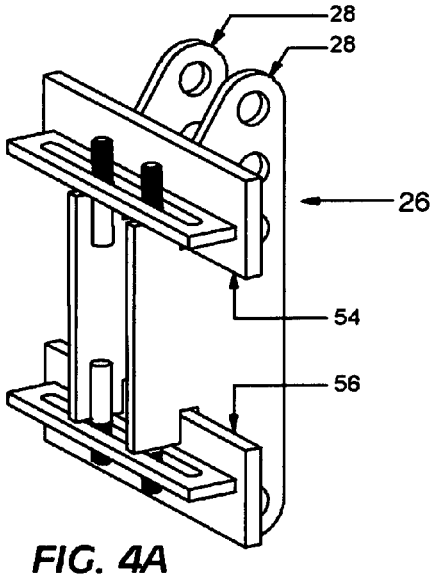
FIG. 4*a* is a perspective view of a universal mount prior to having the side mount plates welded in place, this figure also represents the adapter as needed when being fitted to an alternate embodiment design using a frame built with square tubing.

FIG. 4*a* which is a perspective view of the universal mount bracket without side plates 70 prior to having the left and right side mount plates 66 affixed in place by the means of welding or the like. This figure also represents the universal mount bracket 26 as needed when being fitted to an alternate embodiment design using a frame 80 built with square tubing, shown in FIGS. 6A and 6B.

Figure 4B:
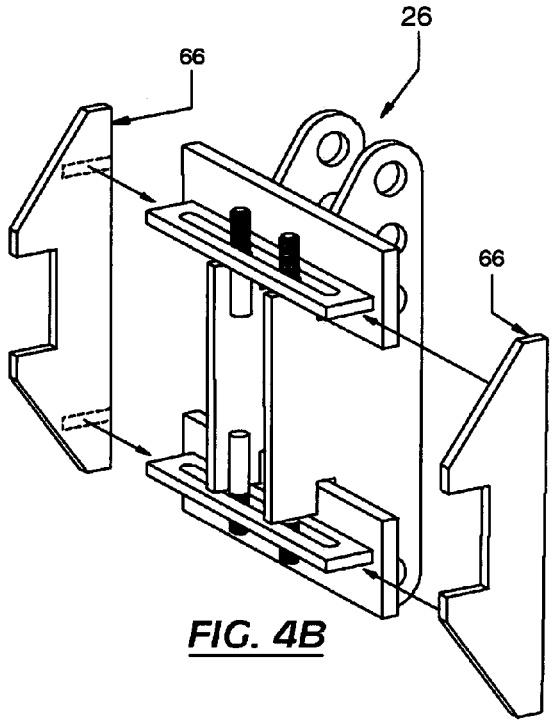

FIG. 4*b* is a perspective view of a universal mount bracket 26 revealing where the left and right side mount plates 66 are to be affixed to when building a universal mount bracket with side plates 72.

Figure 4C:
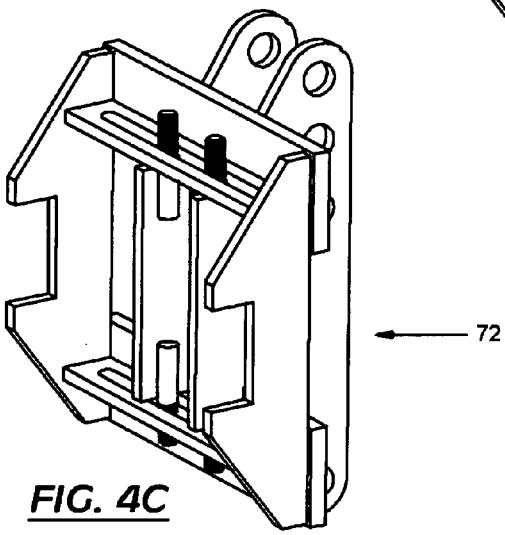
FIG. 4*c* is a perspective view of a universal mount after the side mount plates have been attached, it is this figure that represents the adapter mount as needed when fitted to quick attach assembly using the square tube.

FIG. 4*c*. is a perspective view of a universal mount bracket 26 after the right and left side mount plates 66 have been attached, creating a universal mount bracket with side plates 72. It is this figure that represents the universal mount bracket 26 as needed when creating the universal quick attach adapter 14 which uses a tube 78, being square, round or the like.

FIG. 5*a* which is a side view of the universal mount bracket with side plates 72 affixed to a tube 78, and revealing the vertical alignment line 82 providing an alignment line by which the upper pin hole options are vertically aligned with the lower pin hole 32 of the adapter plate 28.

FIG. 5*b* is a rear perspective view of a left and right universal mount bracket with side plates 72 attached to a tube 78.

Figure 6A:
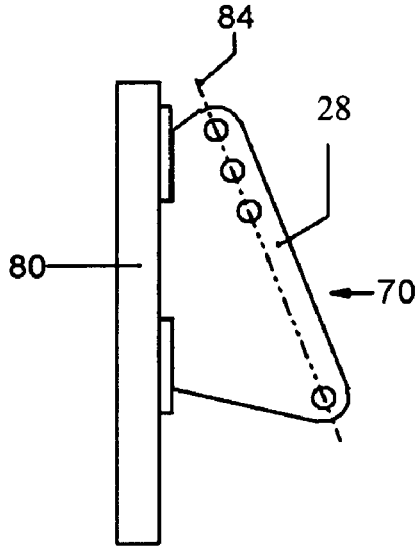
FIG. 6*a* is a side view of a universal mount attached to a steel frame built from square tubing.

FIG. 6*a* which is a side view of an alternate embodiment revealing the universal mount bracket 26 without side plates affixed to a tube frame 80, or the like, which houses implements such as pallet forks or hay spears, creating a universal equipment implement 76, and revealing the oblique alignment line 84 providing an alignment line by which the upper pin hole options are diagonally aligned with the lower pin hole 32 of the adapter plate 28. Using alignment line 84 creates an alternate embodiment of the adapter plate 28 which may be needed to match various design differences of loader and implement manufacturers.

Figure 6B:
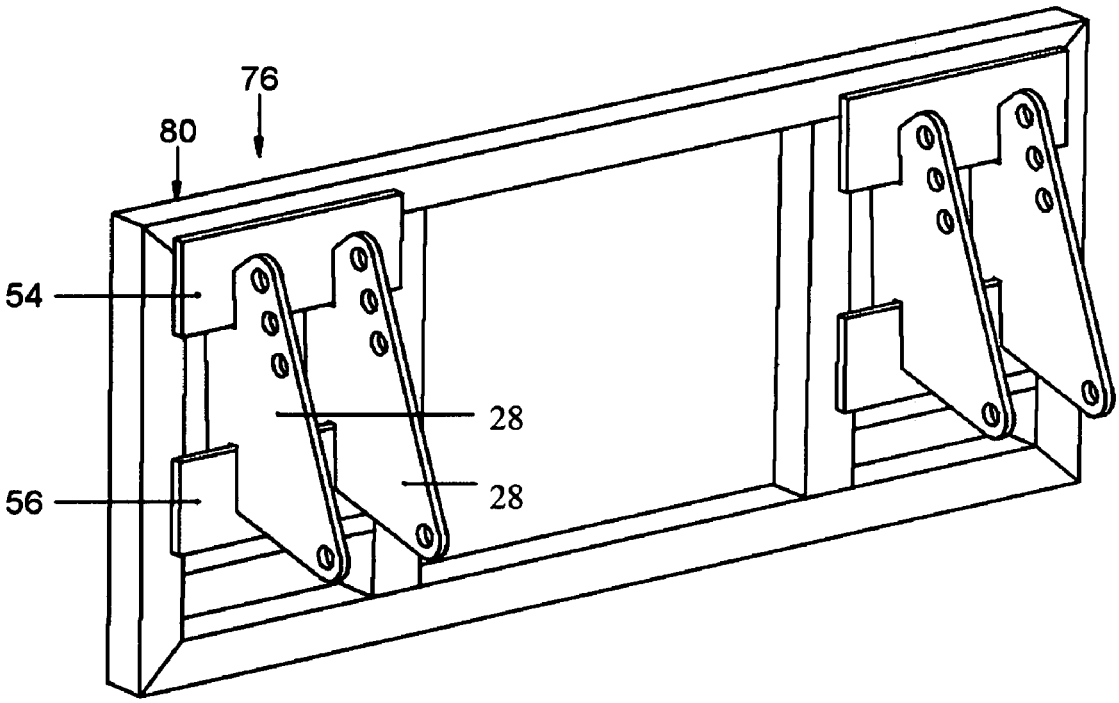
FIG. 6*b* is a rear perspective view of two universal mount brackets without side plates attached to a steel frame built from square tubing, wherewith equipment implements such as pallet forks may be connected.

FIG. 6*b* is a rear perspective view of an alternate embodiment revealing the left and right universal mount bracket without side plates 70 attached to a tube frame 80 creating a framed equipment implement with universal mounts 76. This alternate embodiment may also utilize the adapter plate 28 using the alignment line 84.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What we claim as our invention is:

1. A universal mount bracket for connecting a front end loader having upper and lower arms to an implement, comprising:

means for providing an adapter plate combined with another adapter plate laterally to create a pair of adjustable housings, each housing having two adapter plates, through which a steel pivot pin is inserted through each of said housing through one of an upper plurality of aligned holes in said adapter plate, attaching an upper pin housing of the upper front end loader arms to the adapter plates; another steel pivot pin inserted through a bottom hole of each adapter plate attaching a lower pin housing of the lower front end loader arms to the adapter plates;

means for providing a multi sided center notch at a top and bottom of each adapter plate, which allows said adapter plate to traverse laterally along an upper and lower sliding plates;

means for providing an upper adjuster plate which perpendicularly affixes to the upper sliding plate establishing an upper base to securely fasten said adapter plate;

means for providing a lower adjuster plate which perpendicularly affixes to the lower sliding plate establishing a lower base to securely fasten said adapter plate;

means for adjustably securing each of the adapter plates to said upper adjuster plate, preventing the adapter plate from lateral displacement while the unit is in use;

means for securing each of the adapter plates to a lower adjuster plate, preventing the adapter plate from lateral displacement while the unit is in use;

means for providing a slot in said upper and lower adjuster plates to adjustably laterally attach said adapter plates to said upper and lower adjuster plates;

means for providing a quick attach assembly connected to the adapter plates and to the implement.

2. The universal mount bracket in accordance with claim 1, wherein said means for adjustably securing the adapter plate to said upper adjuster plate and means for adjustably securing the adapter plate to said lower adjuster plate comprises a bolt extending from said adapter plate, and further comprises washer and nut connected to said bolt.

3. The universal mount bracket in accordance with claim 1, wherein said upper plurality of aligned holes includes three holes.

4. The universal mount bracket in accordance with claim 1, wherein said upper plurality of aligned holes is either vertically or diagonally oriented.

5. The universal mount bracket in accordance with claim 1, wherein at least one of said upper and lower arms of the front end loader are hydraulically operated arms.

6. The universal mount bracket in accordance with claim 1, wherein said means for providing a quick attach assembly connected to the adapter plates and to the implement includes a tube affixed to each of the housings, where each housing further includes a left and right side mount plate that is connected to said upper and lower adjuster plates and said upper and lower sliding plates.

7. The universal mount bracket in accordance with claim 1, wherein said means for providing a quick attach assembly connected to the adapter plates and to the implement includes a tube frame connecting each the pair housings.

* * * * *